US006230406B1

(12) United States Patent
Balfour et al.

(10) Patent No.: US 6,230,406 B1
(45) Date of Patent: May 15, 2001

(54) FLEXIBLE BOND HARNESS AND MANUFACTURING METHOD THEREFOR

(75) Inventors: William J. Balfour, Winsted; John W. Auclair, Norfolk, both of CT (US)

(73) Assignee: Electric Motion Company, Inc., Winsted, CT (US)

( * ) Notice: Subject to any disclaimer, the term of this patent is extended or adjusted under 35 U.S.C. 154(b) by 0 days.

(21) Appl. No.: 09/228,014

(22) Filed: Jan. 11, 1999

(51) Int. Cl.[7] ..... H01R 43/04

(52) U.S. Cl. ..... 29/863; 29/857; 29/861; 29/862; 29/863; 29/865; 29/866; 29/867; 29/745; 29/747; 29/748; 29/751; 29/753; 29/755; 439/96; 439/98

(58) Field of Search ..... 439/98, 96; 29/857, 29/861, 862, 863, 865, 866, 867, 745, 747, 748, 751, 753, 755

(56) References Cited

U.S. PATENT DOCUMENTS 4,212,047 * 7/1980 Napiorkowski ..... 361/124
4,361,719 * 11/1982 Hyde ..... 174/6
4,485,361 * 11/1984 Bender ..... 332/32
4,665,281 * 5/1987 Kamis ..... 174/102 R
4,842,530 * 6/1989 Erickson, II ..... 439/98
5,021,005 * 6/1991 Slenker ..... 439/421

OTHER PUBLICATIONS

Electric Motion Company, Inc., "#6AWG Flexible Ground Strap," published before Jan. 11, 1998.
Page from Alltel Supply Catalog, 1996.

* cited by examiner

*Primary Examiner*—Lee Young
*Assistant Examiner*—Paul D. Kim
(74) *Attorney, Agent, or Firm*—Alix, Yale & Ristas, LLP

(57) ABSTRACT

A flexible bond harness including a flexible ground subassembly and a rigid ground subassembly which are joined together by a barrel connector. The flexible ground assembly has a first terminal connector which is mounted to the distal end portion of a substantially flexible conductor and the rigid ground assembly has a second terminal connector which is mounted to the distal end portion of a substantially rigid conductor. The barrel connector has a substantially uniform thickness, first and second side walls, a base and is divided into first and second segments. The proximal end portion of the flexible conductor is positioned within the first segment and the proximal end portion of the rigid conductor is positioned within the second segment. The first and second segments of the barrel connector are simultaneously crimped onto the flexible and rigid conductors, respectively, forming a bond which prevents relative motion between the barrel connector and the flexible and rigid conductors.

12 Claims, 6 Drawing Sheets

FLEXIBLE BOND HARNESS AND MANUFACTURING METHOD THEREFOR

BACKGROUND OF THE INVENTION

This invention relates generally to devices for implementing a ground connection between a metallic sheath of a cable and a common ground point. More particularly, the present invention relates generally to devices for providing a waterproof ground connection between a metallic sheath of a cable and a common ground point.

Buried telecommunications cables often utilize a distribution pedestal for housing cable ends and splices. These pedestals provide easy access to the cable ends without excavation of the buried cables for splice installations, maintenance and troubleshooting. However, such pedestals are not a closed environment and rain run-off or other ground water may enter the splice. This moisture will contribute to the corrosion of the copper conductors and metallic sheath leading to a degradation of the mechanical integrity and the electrical characteristics of the cable. Generally, the splices are made watertight to prevent the introduction of water. The splices may be made watertight by encapsulating or flooding the splice area with a urethane or gel compound. Alternatively, the splice bundle may be enclosed in a heat shrinkable enclosure.

If the cable includes a metallic sheath, the sheath must be electrically bonded to the pedestal housing. The housing, in turn, should be grounded. Consequently, a grounding conductor, typically a number 6 AWG conductor, must exit the encapsulated/housed splice for connection to the pedestal housing. In geographic areas which are subject to ground freeze/thaw cycles, there is relative movement between the pedestal housing and the cables since the cables are usually buried below the frost line and the pedestal housing is buried at least partially above the frost line. If the ground connection is not sufficiently flexible to accommodate such relative movement or roadside vibration, the watertight seal will be jeopardized. A solid number 6 AWG conductor is relatively stiff and is too inflexible to properly accommodate relative motion between the pedestal housing and the splice. If a stranded number 6 AWG conductor is used, moisture can wick into the space between the individual conductors and enter the splice.

One conventional grounding device mounts a solid number 6 AWG conductor to a stranded number 6 AWG conductor via a butt splice. The solid conductor is mounted to the cable sheath and extends out of the encapsulated/housed splice. The stranded conductor provides sufficient flexibility to allow relative movement between the splice and the pedestal housing. Although both conductors are number 6 AWG, the outside diameter of the stranded conductor is greater than that of the solid conductor. Typically, a connector having one end which is sleeved to reduce the inside diameter is used to ensure that connector is properly crimped. Such connectors are relatively expensive. In addition, the assembly worker must identify which end of the connector has been sleeved and orient the connector to insert each conductor into the proper end of the connector. Consequently, it takes a relatively long time to assemble each grounding device even though the device has a relatively simple design.

In addition to the difficulty of properly connecting two different diameter conductors, crimped connections are subject to degradation of their mechanical and electrical properties if they do not provide a "gas tight" connection. A crimped wire connection is "gas tight" if all of the individual conductors of a stranded conductor are compressed together leaving no voids for air and moisture to enter. For a solid conductor, the connection is "gas tight" if the conductor cannot rotate within the connector. If the connection is not "gas tight" moisture will enter the connection causing corrosion which degrades the mechanical connection and electrical properties of the connection. It is especially difficult to insure that both connections in a butt splice are "gas tight" when a solid conductor is joined to a stranded conductor and the conductors have different diameters.

SUMMARY OF THE INVENTION

Briefly stated, the invention in a preferred form is a flexible bond harness which includes a flexible ground subassembly and a rigid ground subassembly which are joined together by a barrel connector. The flexible ground assembly has a first terminal connector which is mounted to the distal end portion of a substantially flexible conductor and the rigid ground assembly has a second terminal connector which is mounted to the distal end portion of a substantially rigid conductor. The outside diameter (Df) of the flexible conductor is greater than the outside diameter (Dr) of the rigid conductor. The longitudinally extending barrel connector has a substantially uniform thickness, first and second side walls and a base. The barrel connector is divided into first and second segments extending from the first and second ends, respectively, to a position intermediate the first and second ends. The proximal end portion of the flexible conductor is positioned within the first segment and the proximal end portion of the rigid conductor is positioned within the second segment. The first and second segments of the barrel connector are simultaneously crimped onto the flexible and rigid conductors, respectively, forming a bond which prevents relative motion between the barrel connector and the flexible and rigid conductors.

The bond is fashioned, in part, by a cold weld connection which is formed between the longitudinally extending leading edges of each side wall of the barrel connector conductor. The bond is also fashioned by mechanical engagement between the flattened base of the barrel connector and a flattened surface of the conductor. A similar bond is formed between the mounting portion of each terminal connector and the distal end portion of the rigid or flexible conductor. That is, the longitudinally extending leading edges of each side wall of the mounting portion forms a cold weld with the conductor and the flattened base of the mounting portion mechanically engages a flattened surface of the conductor.

The flexible bond harness is manufactured utilizing a pair of work stations. The first work station has a first die and an associated first punch for crimping the portion of a barrel connector containing the stranded conductor and a second die and an associated second punch for crimping the portion of the barrel connector containing the solid conductor. The second work station contains either a first die and punch or a second die and punch. The first and second dies each include an inner surface having a profile and defining a cavity. The profile of the first die is substantially identical to the profile of the second die. The first and second punch each have a punch segment having an intermediate surface and first and second bar segments which extend upwardly from the intermediate surface to an upper surface. The intermediate surface and upper surface of each punch define a height where the height of the second punch is greater than the height of the first punch.

The barrel connector has a substantially uniform thickness and first and second connector segments. Each of the connector segments has first and second side walls and a base. The barrel connector is positioned in the first work station such that the first connector segment is positioned intermediate the first die and the first punch and the second connector segment is positioned intermediate the second die and the second punch. A second end portion of the flexible conductor is positioned in the first connector segment and a second end portion of the rigid conductor is positioned in the second connector segment.

The work station press is activated, causing the first and second punches to be moved toward the first and second dies, sequentially causing the following steps to occur: a) the first and second bar segments of the second punch engage the second connector segment; b) the first and second side walls of the second connector segment slide on the inner surface of the second die to commence crimping the second connector segment to the rigid conductor and the first and second bar segments of the first punch engage the first connector segment; c) the first and second side walls of the first and second connector segments slide on the inner surface of the first and second dies to crimp the first and second connector segment to the flexible and rigid conductors, respectively, until a portion of the bar segments of the first and second punches are positioned within the cavities of the first and second dies, respectively. As the crimping is completed, the remaining web for the barrel connector is severed in the same tool, releasing the completed part. At the completion of the crimping operation, the first and second punches move together away from the first and second dies, respectively, and the flexible bond harness is removed from the first work station.

During the crimping operation, the intermediate surface of the first and second punches engage and flatten the base of the first and second connector segments, respectively, and the second end portions of the flexible and rigid conductors adjacent the base of the first and second connector segments. Also, the edge portions of the first and second side walls of the first and second connector segments engage and form a cold weld with the flexible and rigid conductors, respectively. The profiles of the first and second dies each have an M-shape comprising a pair of arc segments separated by a downwardly protruding ridge. The first and second side walls slide along the arc segments, forming an arcuate shape, and the ridge directs the edge portions into engagement with the flexible and rigid conductors. The pressure created by the first punch and the first die causes the individual conductor strands of the second end portion of the flexible conductor to cold weld, forming a solid conductor.

The first and second terminals are mounted onto the conductors in a similar operation in the second work station. The mounting portion of a terminal is positioned intermediate the die and punch of the second work station. The first end portion of the flexible conductor or the rigid conductor is positioned in the mounting portion and the terminal is crimped to the conductor by moving the punch toward the die.

During the crimping operation, the intermediate surface of the punch engages and flattens the base of the mounting portion and the first end portions of the conductor adjacent the base. Also, the edge portions of the side walls of the mounting portion engage and form a cold weld with the conductor. The side walls slide along the arc segments of the die, forming an arcuate shape, and the ridge directs the edge portions into engagement with the conductor. The pressure created by the punch and the die cause the individual conductor strands of the first end portion of the flexible conductor to cold weld, forming a solid conductor.

It is an object of the invention to provide a new and improved harness for implementing a flexible ground connection between the metallic sheath of a cable and a ground point.

It is also an object of the invention to provide new and improved harness which is easier and less expensive to produce than conventional harnesses.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Buried telecommunications cables often utilize a distribution pedestal for housing cable ends and splices. If the cable includes a metallic sheath, the sheath must be bonded to a metallic pedestal housing. Generally, the splices are made watertight by encapsulating the splice area with a urethane or gel compound or enclosing the splice in a heat shrinkable enclosure. If the ground connection is not sufficiently flexible to accommodate relative movement between the ground connector and the pedestal housing, the watertight seal will be jeopardized.

Figure 1:
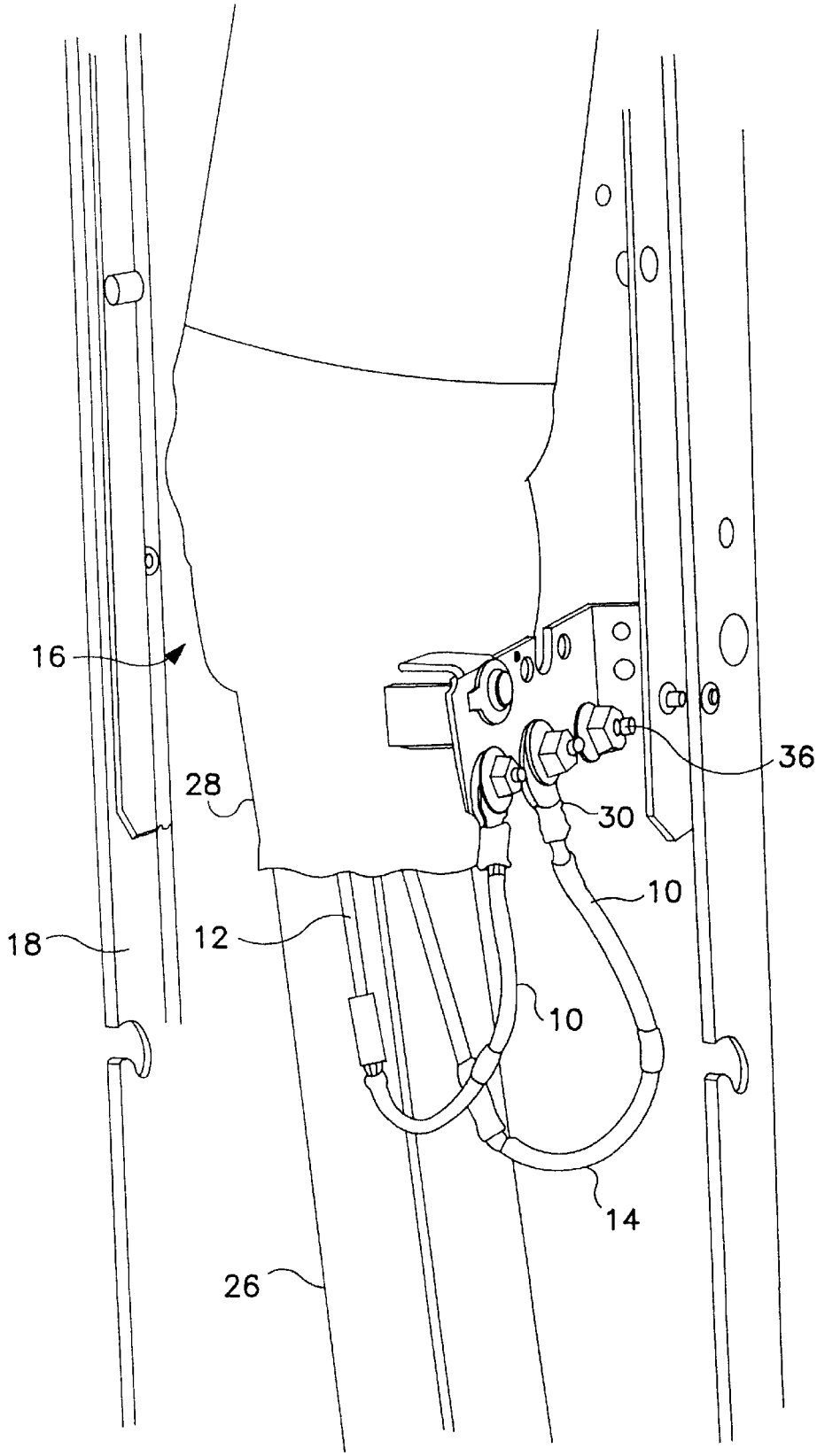
FIG. 1 is perspective view of a flexible bond harness in accordance with the invention installed in a pedestal enclosure partially illustrated.

With reference to the drawings wherein like numerals represent like parts throughout the several figures, a flexible bond harness in accordance with the present invention is generally designated by the numeral 10. The harness 10 (FIG. 1) combines a relatively inflexible solid conductor 12 with a relatively flexible stranded conductor 14 to provide a ground connection for a cable splice 16 which will allow relative movement between the cable splice 16 and the pedestal enclosure 18 without providing a leak path into the cable splice 16. In a preferred embodiment, both the solid conductor 12 and stranded conductor 14 are #6 AWG conductors. Smaller or larger conductors may be utilized depending on the amperage rating of the conductors and the specific ground load requirements of the particular installation.

Figure 2:
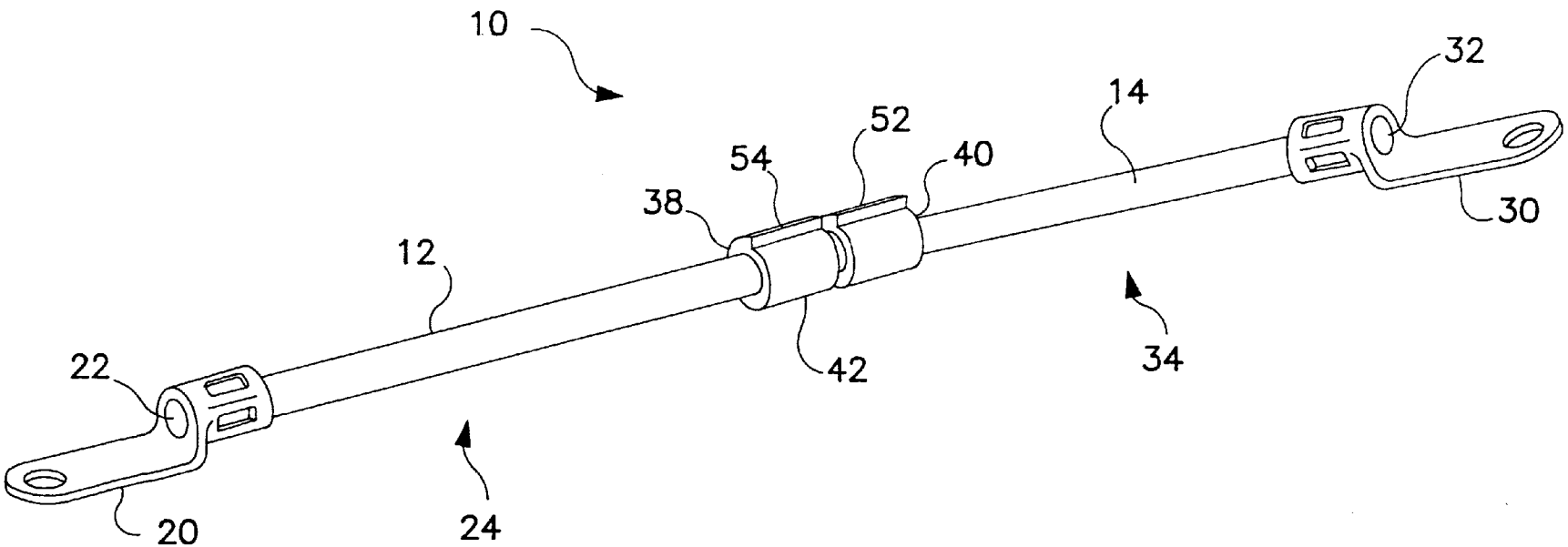
FIG. 2 is an enlarged perspective view of the flexible bond harness of FIG. 1.

With reference to FIG. 2, a first terminal connector 20, such as a ring terminal, is crimped onto the distal end portion 22 of the solid conductor 12, as described below, to form a rigid ground subassembly 24. With additional reference to FIG. 3, the ring terminal 20 is mounted to the electrically conductive sheath of the cable 26 such that the solid conductor 12 extends out of the encapsulating compound or the watertight enclosure 28 that surrounds the cable splice 16. The encapsulating compound or enclosure 28 forms a watertight seal with the smooth outer surface of the solid conductor 12. Since a solid, relatively inflexible conductor 12 is utilized to provide this portion of the ground path, rather than a relatively flexible stranded conductor, the conductor does not have internal voids which would provide an internal leakage path into the sealed splice area.

A second terminal connector 30, such as a ring terminal, is crimped onto the distal end portion 32 of the stranded conductor 14, as described below, to form a flexible ground subassembly 34. The ring terminal 30 is mounted to a ground terminal 36 on the pedestal housing 18. Since the stranded construction of the conductor 14 is relatively flexible, the stranded conductor 14 accommodates relative movement between the cable 26 and the pedestal housing 18.

A proximal end portion 38 of the solid conductor 12 is mounted to an proximal end portion 40 of the stranded conductor 14 by a butt splice connector 42 to join the rigid ground subassembly 24 to the flexible ground subassembly 34. Although both the solid conductor 12 and the stranded conductor 14 are the same size, as dictated by the single ground load rating of the harness, the outside diameter of the stranded conductor 14 is greater than that of the solid conductor 12 due to the voids between the individual strands.

A conventional butt splice connector for joining conductors of different diameters typically is a cylindrical member having oppositely disposed bore segments that are separated by a conductor positioning tang that extends inwardly to partially close the midpoint of the bore. The inside diameter of the bore segment designated for the smaller diameter conductor is reduced, for example by a sleeve, such that the gap between the inside surface of reduced diameter bore segment and the smaller diameter conductor is substantially equal to the gap between the inside surface of the other bore segment and the larger diameter conductor. Therefore, a single crimp die and punch providing a uniform compression of both bore segments will properly join the two conductors. Such connectors are relatively expensive to manufacture. In addition, the assembly worker must identify the end of the connector has the reduced diameter bore segment to orient the connector such that each conductor is inserted into the proper end of the connector. Consequently, it takes a relatively long time to connect two conductors having dissimilar diameters even though the connector has a relatively simple design.

Figure 3:
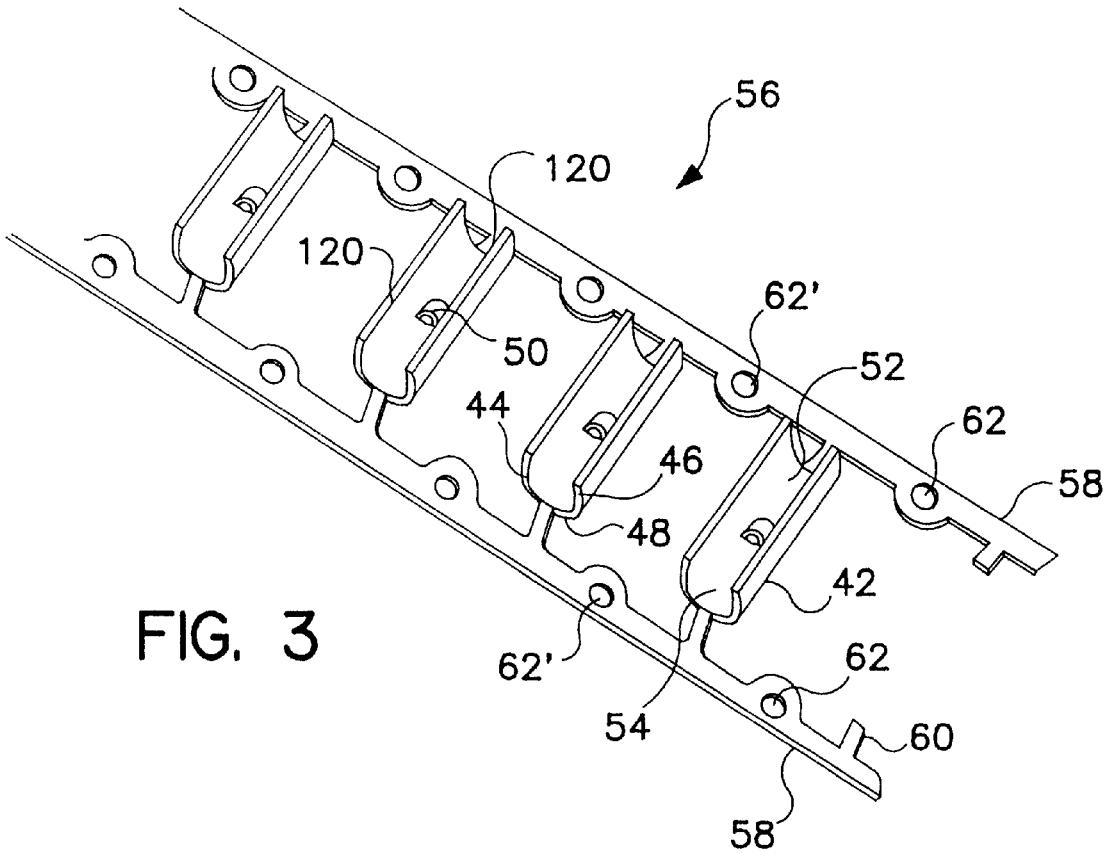
FIG. 3 is a perspective view of a representative strip of butt splice connectors used in the manufacture of the flexible bond harness of FIG. 1.

With reference to FIG. 3, the butt splice connector 42 of the subject invention is a U-shaped open barrel terminal defining a trough having a pair of side walls 44, 46 extending vertically upward from a base 48. When viewed from either end, the side walls 44, 46 of the terminal have an arcuate shape. A conductor positioning tang 50 extends upwardly into the trough at the midpoint of the barrel to define two substantially identical trough segments 52, 54. The length of the trough segments 52, 54 is selected to ensure that the length of the conductor which is received in the trough segment 52, 54 is sufficient to provide both the proper mechanical pull-out resistance and the proper electrical characteristics. Unlike the conventional butt splice connector described above, the wall thickness of the connector 42 is substantially uniform throughout its length and each of the trough segments 52, 54 may receive either the thinner solid conductor 12 or the thicker stranded conductor 14.

The butt splice connector 42 may be manufactured from a uniform strip of tin coated copper in a simple stamping operation and therefore is easier and less costly to manufacture than the conventional butt splice connector. As shown in FIG. 3, the stamping operation produces a continuous strip 56 carrying a series of butt splice connectors 42. The opposite ends of each butt splice connector are integrally attached to an indexing member 58 by a flash bridge 60. The cross-sectional area of the connection between the flash bridges 60 and the butt splice connectors 42 is reduced during the stamping operation to facilitate removal of the butt splice connector 42 from indexing members 58 during assembly of the flexible bond harness 10. Each flash bridge 60 extends upwardly and inwardly from a respective indexing member 58 such that the butt splice connector 42 is positioned above the plane defined by the indexing members 58. This positioning facilitates assembly of the flexible bond harness 10 as described below. An opening 62 extends through each indexing member 58 intermediate each set of adjacent butt splice connectors 42.

Figure 5:
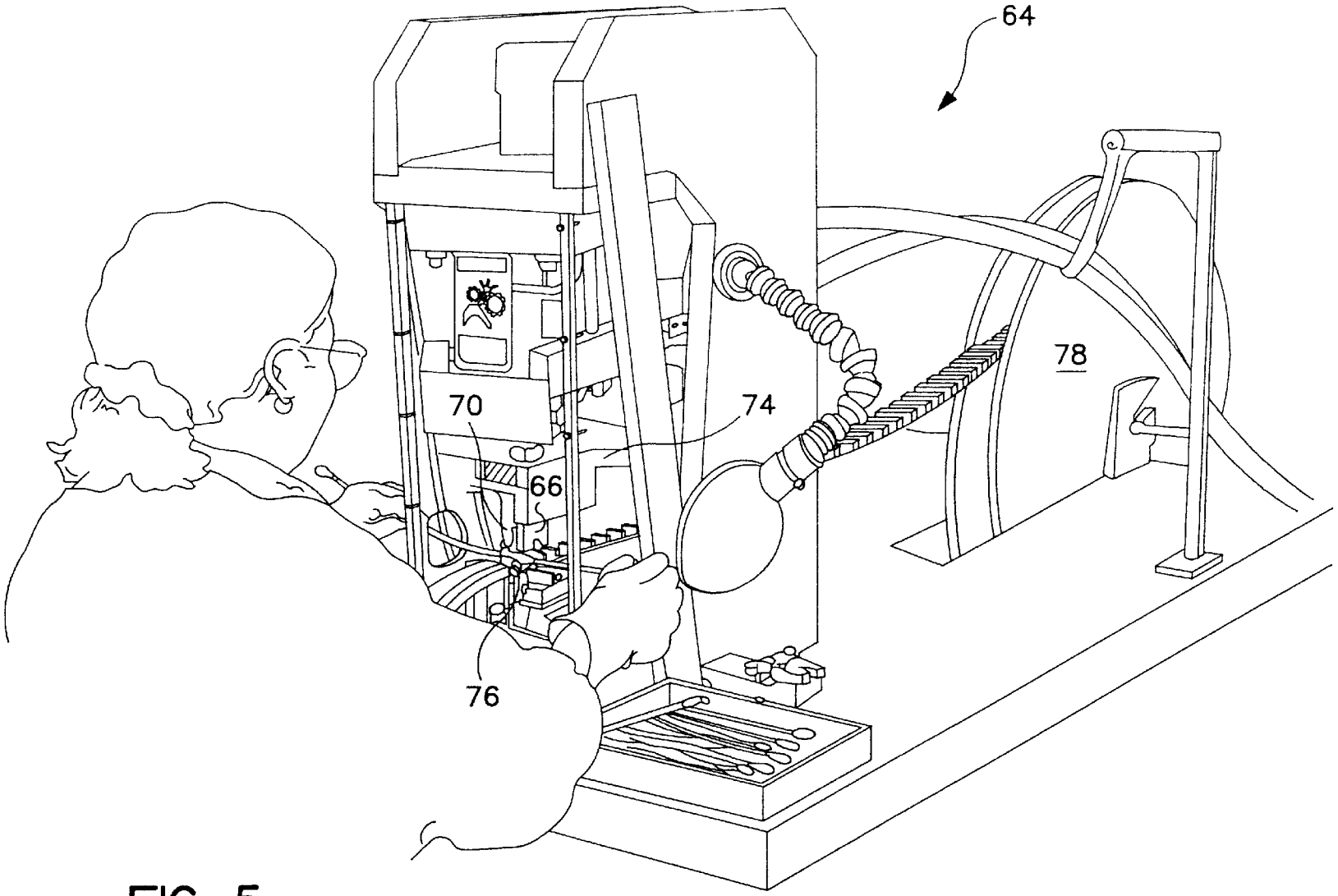
FIG. 5 is a perspective view of a work station where the butt splice of the flexible bond harness of FIG. 1 is formed together with an operator illustrating a manufacturing step therefor.

As shown in FIG. 5, the rigid ground subassembly 24 is joined to the flexible ground subassembly 34 at a work station 64 having a first "stranded" die 66 and punch 68 for crimping segment 52 of the connector 42 containing the stranded conductor 14, a second "solid" die 70 and punch 72 for crimping the segment 54 of the connector 42 containing the solid conductor 12, a hydraulic press 74, and a tractor feed mechanism 76. The tractor feed mechanism 76 engages the distal end portion of strip 56 to pull the strip 56 of butt splice connectors 42 off of a storage reel 78. Pins on the tractor feed mechanism 76 are received within cooperating openings 62 in both indexing members 58 to provide controlled engagement between the tractor feed mechanism 76 and the indexing members 58. The distance between successive openings 62, 62' in each indexing member 58 and the distance between adjacent pins of the tractor feed mechanism 76 are selected such that the trough segments 52, 54 of a single butt splice connector 42 are positioned between the stranded and solid dies 66, 70 and the stranded and solid punches 68, 72, respectively, after each actuation of the press 74. Since either trough segment 52, 54 will accept both the solid conductor 12 and the stranded conductor 14, the strip 56 does not have to be oriented with respect to the conductors 12, 14.

Figure 6:
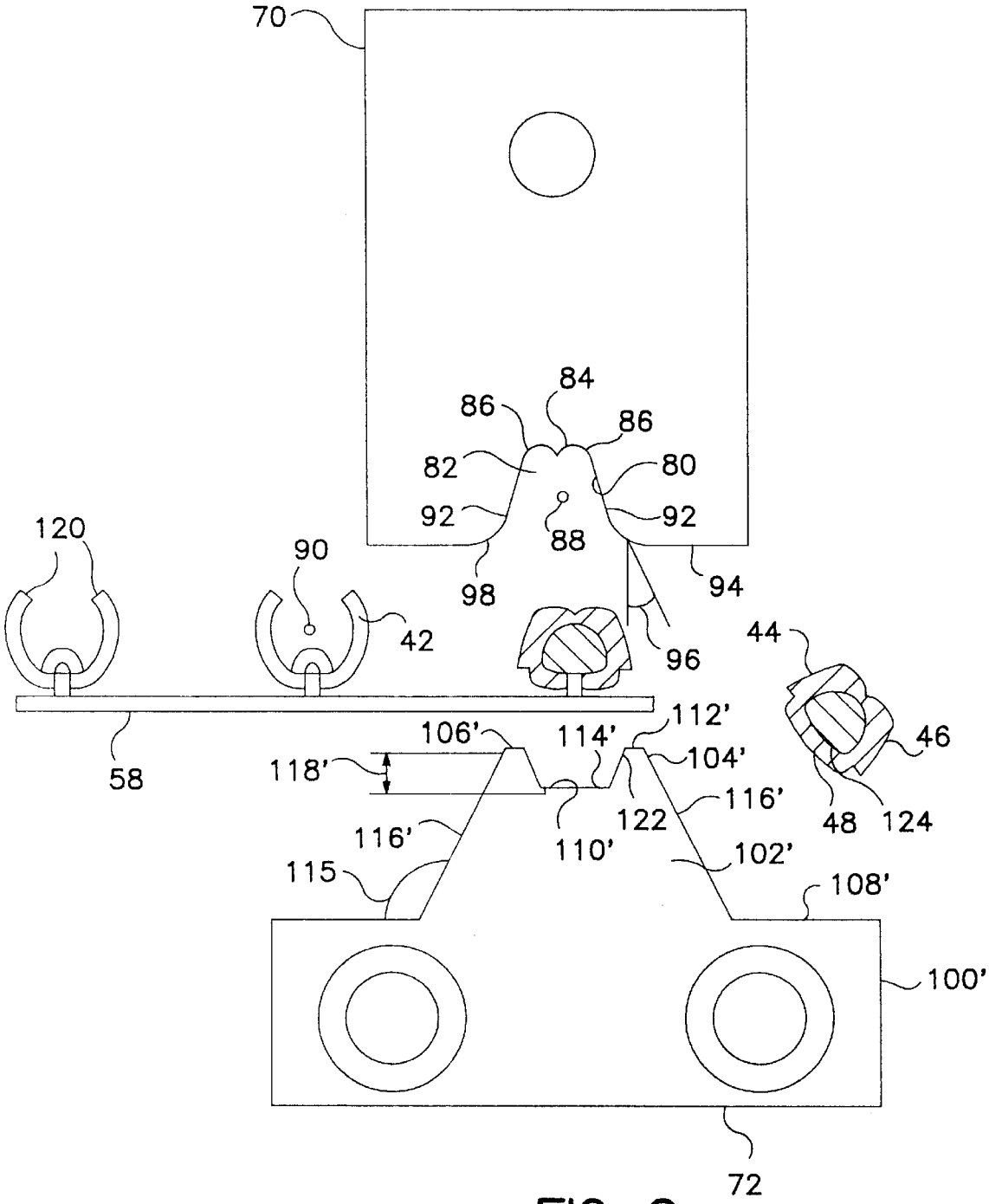
FIG. 6 is a schematic side view of a solid conductor crimp die and punch of FIG. 5, the strip of butt splice connectors of FIG. 3, and the flexible bond harness of FIG. 1 illustrated in section.
Figure 7:
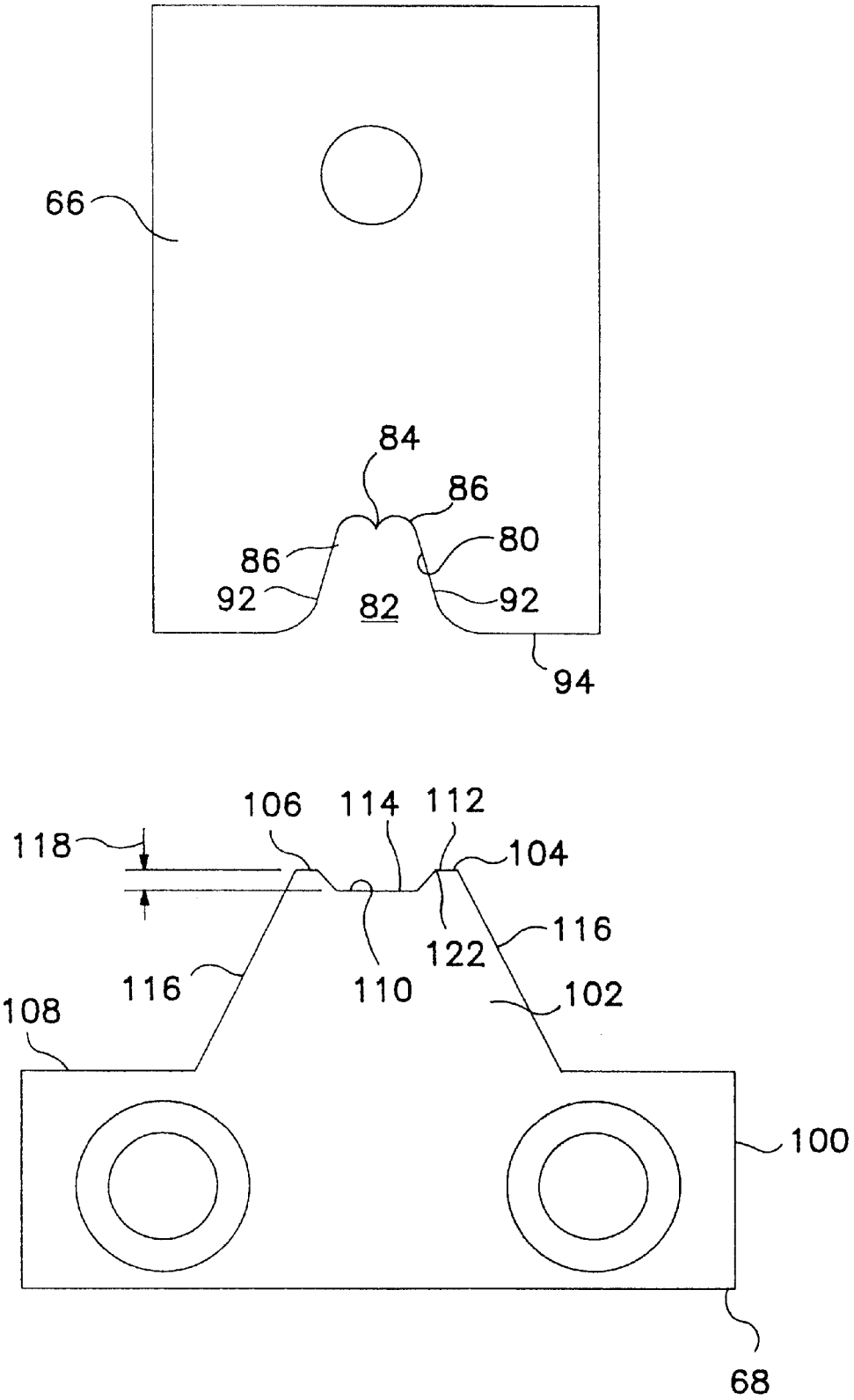
FIG. 7 is a schematic side view of a stranded conductor crimp die and punch of FIG. 5.

With further reference to FIGS. 6 and 7, the inner surface 80 of both the stranded die 66 and the solid die 70 have a similar profile. Preferably, the profiles are identical. The die cavity 82 forms an inverted "U" having a downwardly protruding ridge 84 which divides the upper end portion of surface 80 into a pair of mirror image arc segments 86. When viewed from the side, the surface of the die cavity looks substantially like the letter "M", where the surfaces that form the letter are cursive rather than straight. The axis 88 of the die cavity 82 is substantially parallel to the axis 90 of the butt splice connector 42 when the rigid ground subassembly 24 is mounted to the flexible ground subassembly 34. In a die 66, 70 for a butt splice connector 42 for #6 AWG conductors, the arc segments 86 preferably have a radius of 0.064 inches. The side portions 92 of surface 80 extend outwardly and downwardly from arc segments 86 to the bottom surface 94 of the die 66, 70. Preferably, the angle 96 formed between each side portion 92 of surface 80 and the vertical is substantially equal to 20°. The junction of the side portions of surface 80 and the bottom surface 94 forms a curve 98 having a radius of 0.125 inches.

As shown in FIGS. 6 and 7, both of the punches 68, 72 include a rectangular base segment 100, a punch segment 102, and two bar segments 104, 106, which are substantially parallel to the axis 90 of the butt splice connector 42 when the rigid ground subassembly 24 is mounted to the flexible ground subassembly 34. The punch segment 102 has the shape of a truncated pyramid, when viewed from the side, where the side surfaces of the punch segment 102 extend upwardly and inwardly from the upper surface 108 of the base segment to an intermediate surface 110. The bar segments 104, 106 each extend from the intermediate surface 110 of the punch segment 102 to an upper surface 112, where the upper surface 112 of the first bar segment 104 is coplanar with the upper surface 112 of the second bar segment 106, and are separated by a longitudinally extending groove 114. Each bar segment 104, 106 has the shape of a truncated pyramid when viewed from the side, where the outboard side surfaces of the bar segments 104, 106 are coplanar with the side surfaces of the punch segment 102. Preferably, the angle 115 formed between each side surface 116, 116' and the horizontal upper surface 108, 108' of the base segment 100, 100' is substantially equal to 115°.

The distance between the intermediate surface 110 of the punch segment 102 and the upper surface 112 of the bar segments 104, 106 define a height 118, where the height 118' of the bar segments 104', 106' of the solid punch 72 is greater than the height 118 to the bar segments 104, 106 of the stranded punch 68. Consequently, the bar segments 104', 106' of the solid punch 72 engage the side walls 44, 46 of the trough segment 54 containing the solid conductor 12 before the intermediate surface 110' engages the base surface 48 of trough segment 54 and before any portion of the stranded punch 68 engages the trough segment 52 containing the stranded conductor 14. Further, the bar segments 104', 106' of the solid punch 72 extend further into the die cavity 82 when the press 74 is at the top of its stroke than the bar segments 104, 106 of the stranded punch 68. As a result, the solid punch 72 compresses the trough segment 54 containing the solid conductor 12 to a greater extent than stranded punch 68 compresses the trough segment 52 containing the stranded conductor 14. The greater compression ensures that the smaller diameter solid conductor 12 is properly crimped. It should be appreciated that the assembly worker must ensure that the proximal end portion 38 of the solid conductor 12 is placed within the trough segment 54 positioned between the solid die 70 and punch 72 and the proximal end portion 40 of the stranded conductor 14 is placed within the trough segment 52 positioned between the stranded die 66 and punch 68. The connector 42 is severed from the rest of the web or strip 56 at the completion of the crimping process to allow the assembled workpiece to be released. The connector 42 may be severed as a result of advancing the strip 56 and rolling over the weak flash bridges 60. The punches 68, 72 are withdrawn from the dies 66, 70 during the down stroke of the press 74 to allow the assembled workpiece or assembled flexible bond harness 10 to be withdrawn from the work station 64.

With further reference to FIGS. 6 and 7, the profile of the die 66, 70 and punch 68, 72 ensure that the connector 42 is crimped in a manner that produces a gas-tight connection. The leading edges 120 of the connector side walls 44, 46 engage the arc segments 86 of the die surface 80 as the connector 42 is crimped, forcing the leading edges 120 inward and downward toward the surface of the conductor 12, 14. The ridge 84 of the die 66, 70 engages the leading edges 120 forcing them into such intimate engagement with the surface of the conductor 12, 14 that a cold-welded joint is formed. Similarly, the in board edge 122 of each of the bar segments 104, 106 engage the side walls 44, 46 of the connector 42 along a laterally extending line and force the side walls 44, 46 into engagement with the conductor 12, 14 resulting in two additional cold welds. The intermediate surface 110 of the punch segment 102 engages the base 48 of the trough and flattens it. As the press continues to force the die 66, 70 and punch 68, 72 together, the base 48 of the trough engages and flattens the adjacent portion of the outside surface 124 of the conductor 12, 14. For the solid conductor 12, the engaged flattened surfaces 48, 124 and the cold welds prevent relative motion between the solid conductor 12 and the connector 42. For the stranded conductor 14, the compression of the conductor 14 causes the strands to become cold-welded, thereby forming a solid conductor within the connector 42. The cold welds formed between the connector 42 and the solid portion of the stranded conductor 14 and the flattened surfaces of the connector 42 and the solid portion of the stranded conductor 14 prevent relative movement between the connector 42 and the stranded conductor 14.

Figure 4:
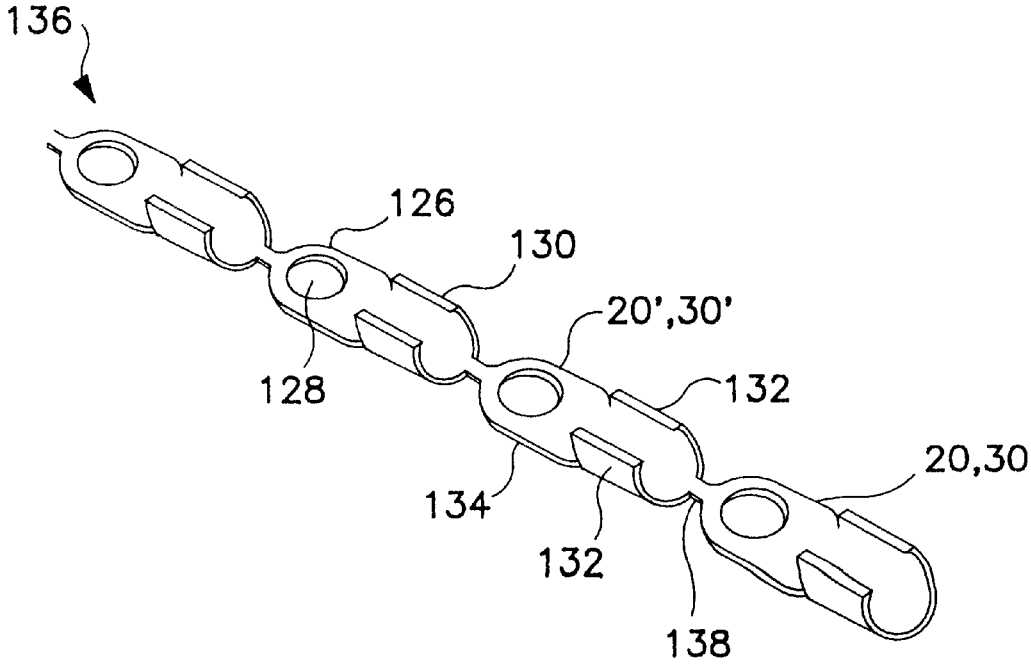
FIG. 4 is a perspective view of a representative strip of ring terminals used in the manufacture of the flexible bond harness of FIG. 1.

Punches and dies having a similar profile to the stranded and solid punches 68, 72 and dies 66, 70 described above are used to mount the ring terminals 20, 30 to the distal end portions 22, 32 of the solid and stranded conductors 12, 14. As shown in FIG. 4, the ring terminal 20, 30 of the subject invention includes a flattened terminal portion 126 having an opening 128 for receiving either a ground post or a mounting post. An integral U-shaped open barrel portion 130 defines a trough having a pair of side walls 132 extending vertically upward from a base 134. When viewed from the end, the side walls 132 of the barrel portion 130 have an arcuate shape. The length of the barrel portion 130 is selected to ensure that the length of the conductor 12, 14 which is received in the barrel portion 130 is sufficient to provide both the proper mechanical pull-out resistance and the proper electrical characteristics. The ring terminals 20, 30 may be manufactured from a uniform strip of tin coated copper in a simple stamping operation The stamping operation produces a continuous strip 136 carrying a series of ring terminals 20, 30. The opposite ends of each ring terminal 20, 30 is mounted to a prior or subsequent ring terminal 20', 30' by a flash bridge 138.

The ring terminals 20, 30 are mounted to the stranded and solid conductors 14, 12 at a work station in a similar manner as described above for the butt splice connector 42. The work station has either a stranded die 66 and punch 68 or a solid die 70 and punch 72, a hydraulic press, and a feed mechanism. The feed mechanism engages the distal end portion of strip 136 to pull the strip of ring terminals 20, 30 off of a storage reel and position a ring terminal 20, 30 between the die and punch after each actuation of the press.

As described above, the height of the bar segments of the solid punch 72 is greater than the height to the bar segments of the stranded punch 68. Consequently, the solid punch 72 compresses the barrel portion 130 of the ring terminals 20 crimped to the solid conductor 12 to a greater extent than stranded punch 68 compresses the barrel portion 130 of the ring terminals 30 crimped to the stranded conductor 14. The greater compression ensures that the smaller diameter solid conductor 12 is properly crimped. As further described above, the profile of the die and punch produces a gas-tight connection between the connector portion of the ring terminal 20, 30 and the conductor 12, 14. The ring terminal is also severed from the rest of the continuous strip at the completion of the crimping of a given ring terminal.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A method for manufacturing a flexible bond harness comprising the steps of:

mounting a mounting portion of a first terminal connector on a first end portion of a substantially flexible conductor having an outside diameter Df;

mounting a mounting portion of a second terminal connector on a first end portion of a substantially rigid conductor having an outside diameter Dr, where Df>Dr;

providing a first work station having a first die and an associated first punch and a second die and an associated second punch;

positioning a barrel connector in the first work station, the barrel connector having a substantially uniform thickness and first and second connector segments, each of the connector segments having a pair of side walls and a base, the first connector segment being positioned intermediate the first die and the first punch and the second connector segment being positioned intermediate the second die and the second punch;

positioning a second end portion of the flexible conductor in the first connector segment and a second end portion of the rigid conductor in the second connector segment;

crimping the barrel connector to the flexible and rigid conductors in the following sequence:

a) moving the first and second punches toward the first and second dies until a portion of the second punch engages the second connector segment, b) moving the first and second punches toward the first and second dies until a portion of the first punch engages the first connector segment, the side walls of the second connector segment sliding on the second die to commence crimping the second connector segment to the rigid conductor, c) moving the first and second punches together toward the first and second dies until at least a portion of the first and second punches are positioned within the first and second dies, respectively, the side walls of the first and second connector segments sliding on the first and second dies, respectively, to complete crimping the first and second connector segment to the flexible and rigid conductors, respectively, and d) withdrawing the first and second punches from the first and second dies, respectively.

2. The method of claim 1 wherein step c) further includes the step of moving the first and second punches toward the first and second dies until the first and second punches engage and flatten the base of the first and second connector segments, respectively, and the second end portions of the flexible and rigid conductors adjacent the base of the first and second connector segments.

3. The method of claim 1 wherein the side walls of the connector segments each have an edge portion and step c) further includes the step of moving the first and second punches together toward the first and second dies until the edge portions of the side walls of the first and second connector segments engage and form a cold weld with the flexible and rigid conductors, respectively.

4. The method of claim 3 wherein the first and second dies each have an inner surface having a profile and defining a cavity, the profiles of each die having an M-shape comprising a pair of arc segments separated by a downwardly protruding ridge, the side walls sliding along the arc segments, forming an arcuate shape, and the ridge directing the edge portions into engagement with the flexible and rigid conductors.

5. The method of claim 1 wherein the flexible conductor comprises a plurality of conductor strands and step c) further includes the step of moving the first and second punches together toward the first and second dies until the conductor strands of the second end portion of the flexible conductor form a cold weld.

6. The method of claim 1 further comprising the steps of:

providing a second work station having a third die and an associated third punch;

positioning the mounting portion of the first or second terminal connector intermediate the third die and the third punch of the second work station, each of the mounting portions having side walls and a base;

positioning the first end portion of the flexible conductor or the rigid conductor in the mounting portion;

crimping the mounting portion to the flexible conductor or the rigid conductor by moving the third punch toward the third die.

7. The method of claim 6 wherein the step of crimping further includes the step of moving the third punch toward the third die until a portion of the third punch engages and flattens the base of the mounting portion and the first end portion of the flexible or rigid conductor adjacent the base of the mounting portion.

8. The method of claim 6 wherein the side walls of the mounting portion each have an edge portion and the step of crimping further includes the step of moving the third punch toward the third die until the edge portions of the side walls of the mounting portion engage and form a cold weld with the flexible or rigid conductor.

9. The method of claim 8 wherein the third die has an inner surface having a profile and defining a cavity, the profile of the third die having an M-shape comprising a pair of arc segments separated by a downwardly protruding ridge, the side walls of the mounting portion sliding along the arc segments, forming an arcuate shape, and the ridge directing the edge portions into engagement with the flexible or rigid conductor.

10. The method of claim 9 wherein the flexible conductor comprises a plurality of conductor strands and the step of crimping further includes the step of moving the third punch toward the third die until the conductor strands of the first end portion of the flexible conductor form a cold weld.

11. The method of claim 6 further comprising providing a strip of terminal connectors and severing the positioned terminal connector from the strip at the second work station.

12. The method of claim 1 further comprising providing a strip of barrel connectors and severing the barrel connector positioned in the first work station from the strip of barrel connectors.

* * * * *